United States Patent [19]

Bliss

[11] Patent Number: 5,037,210

[45] Date of Patent: Aug. 6, 1991

[54] MULTI-PURPOSE MIXING IMPLEMENT AND METHOD OF MIXING MATERIAL

[75] Inventor: William R. Bliss, Newark, Del.

[73] Assignee: Turbomixer Corporation, Newark, Del.

[21] Appl. No.: 368,719

[22] Filed: Jun. 21, 1989

[51] Int. Cl.[5] ..... B01F 7/24

[52] U.S. Cl. ..... 366/279; 366/343

[58] Field of Search ..... 366/312, 320, 344, 342, 366/343, 347, 279, 244, 245, 247, 249, 250, 251; 99/348; 15/210 B, 236.05

[56] References Cited

U.S. PATENT DOCUMENTS 3,132,849 5/1964 Kritikson ..... 366/312
4,558,520 12/1985 Forde ..... 15/210 B
4,575,255 3/1986 kafka ..... 366/344
4,591,389 5/1986 Everitt ..... 15/236.05
4,811,867 3/1989 Deyle ..... 366/320

*Primary Examiner*—Robert W. Jenkins

[57] ABSTRACT

A mixing implement suitable for blending a variety of liquids with other liquids or with particulate matter. The implement comprises one or more coils or helical members threaded through one or more holes in a shaft. The hole being suitable for passage of the coil material through it and the shaft being suitable in length and diameter to drive the coil circularly when immersed in material to be mixed. The shaft is fitted with a resilient collar slidably disposed on the shaft. During mixing, the collar is disposed away from the material to be mixed. Afterwards the collar is slid down the shaft body toward the coil to clean away mixed material clinging to the shaft.

17 Claims, 2 Drawing Sheets

MULTI-PURPOSE MIXING IMPLEMENT AND METHOD OF MIXING MATERIAL

BACKGROUND OF THE INVENTION

The present invention relates to a new mixing device. More particularly, it relates to a shaft driven mixing implement such as might be commonly employed in households and industry to mix paints, stains, epoxies, etc., and to disperse powdered materials like grout, plaster, cement, and pancake flour into liquids. A principle object of the present invention is to provide a device which by virtue of configuration is embodied with advantages over prior art devices for thorough mixing in reduced time period.

When water is agitated in presence of dirt, mud is formed, clouding the water with microscopic solid (dirt) particles in colloidal suspension, thus exhibiting the phenomenon making agitated water bodies appear "muddy". When allowed to stand substantially unagitated for sufficient time, the (dirt) particles will "settle out" clearing the water. Paints, stains, "filled" urethanes, two part Room Temperature Vulcanizing (RTV) Rubber compounds and the like, contain solids which when properly mixed are colloidally suspended. If the fluid is allowed to stand substantially unagitated, the solids will fall out of suspension, massing on the container floor. Homogeneous re-mixing of massed solids into colloidal suspension is often frustrated by multitudinous globular masses which persist in remaining substantially intact through intensive mixing effort.

Powdered materials such as tile grout, plaster, cement and pancake batter present mixing difficulties of a different type. When placed with fluid, powdered material exhibits the phenomenon of agglomeration. Masses of powdered materials form lumps which are resistive to being broken, wetted, dispersed and blended into the liquid. Prior art mixing implements such as propellers, paddles, formed wire and combinations of these shapes are substantially ineffective for dispersing agglomerated solids into liquids. Typically, agglomerated masses are repeatedly deflected off of prior art mixing implements without significant size reduction and reduction in quantity.

The erstwhile shortcomings of prior art mixing devices are addressed and overcome in the present invention. It is therefore an object of the present invention to provide a mixing device suitable for blending various liquid viscosities in reduced time.

Another object of the present invention is to provide a mixing device for uniform redistribution of settled solids into colloidal suspension.

Yet another object of this invention is to provide a mixing device which will disperse agglomerated materials.

A further object of this invention is to provide a mixing device which may be easily reconfigured without tools for tailoring to specific mixing requirements.

A still further object of this invention is to provide a mixing device which is easy to clean.

It is also an object of this invention is to provide a mixing device which will seat squarely on the container bottom though the angular position of the attached drive shaft may be as much as 20° out of perpendicularity with said container bottom.

Another object of this invention is to provide a mixing device which is inexpensive to produce.

SUMMARY OF THE INVENTION

In accordance with the above objects, there has been provided a mixing device comprising a shaft having a length and, in cross section, a geometric center. A hole is placed through the shaft substantiallY near one end, essentially perpendicular to the shaft's longitudinal axis. Through the hole in the shaft is threaded a preformed coil of steel spring wire so that the coil is substantially evenly disposed on both sides of the shaft and its geometric centerline through the coil is essentially perpendicular to the shaft's longitudinal axis. A portion of a single coil loop remains within the hole in the shaft so that when the shaft is turned about its longitudinal axis, the coil is also driven.

Preferably, the implement is sized to accommodate the mixing task at hand and fabricated of materials compatible with materials to be mixed.

Further objects, features, and advantages of the present invention will become apparent from the description of the preferred embodiment when considered together with attached figures of drawing.

DESCRIPTION OF THE PREFERRED EMBODIMENTS

Figure 1:
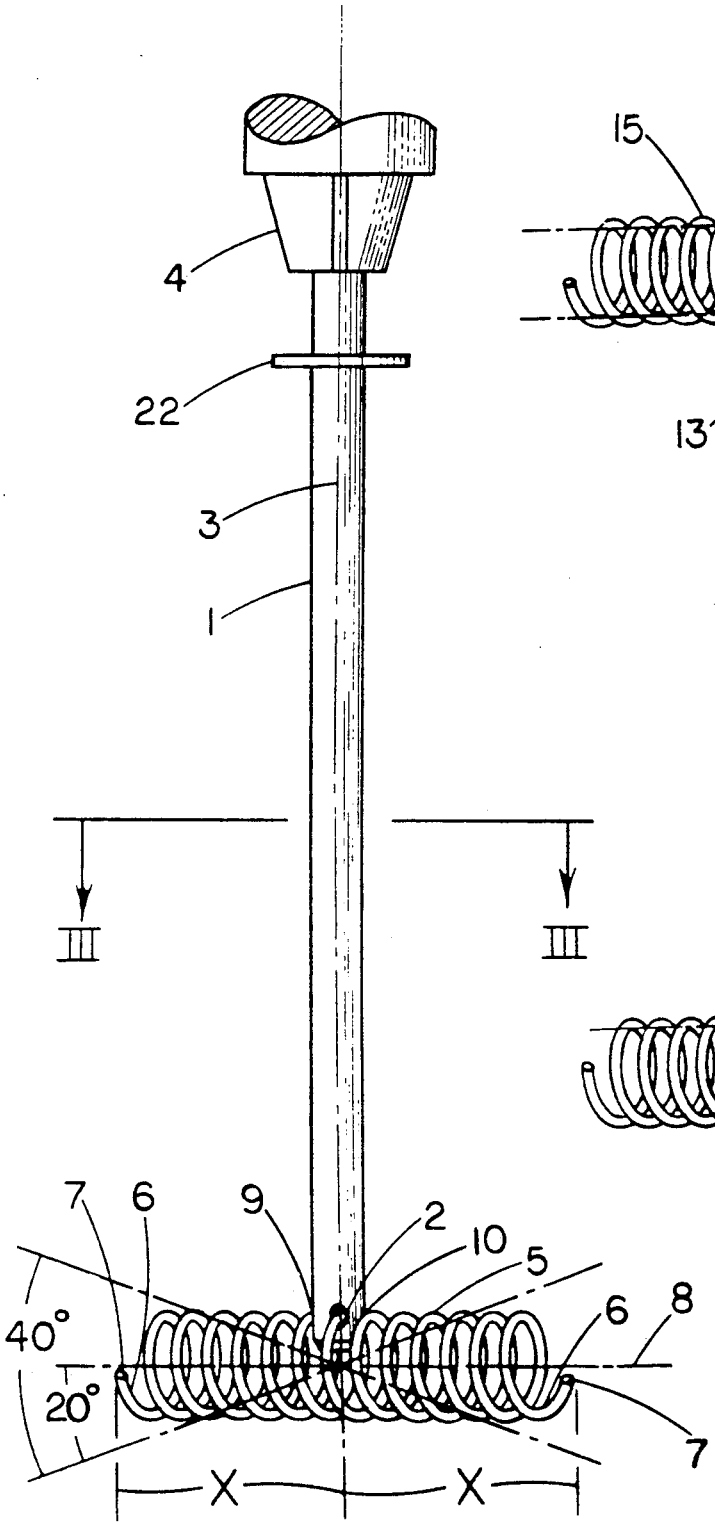
FIG. 1 is a perspective view according to the present invention mounted with a single coil through and near one end of the shaft.

FIG. 1 shows a mixing device according to the present invention with a coil indicated by 5 and a shaft indicated by 1. The shaft 1 has a length suited to the depth of the container in which mixing is to occur and a cross section diameter suitable for attachment to a source of rotational power generally indicated by 4, including, but not limited to, the chuck of a drill motor. A hole generally indicated by 2 through shaft I is positioned substantially near one end and essentially through the center-line of shaft I so that hole 2 is basically perpendicular to the rotational axis and center-line of shaft 1. The diameter of hole 2 and its position near the end of shaft 1 is selected based upon material wire diameter used to fabricate coil 5 and the inside diameter of individual loops forming coil 5.

A preformed coil or helical member, generally indicated by 5, terminating at both ends in an open loop 6 is threaded through hole 2 so that coil ends indicated by 7 are substantially equally distant "X" from shaft 1 center-line indicated by 3. The individual loops of coil 5 have been fabricated so as to provide a residual lateral clamping load on shaft 1 at the loops generally indicated by 9 and 10, adjacent to shaft 1. The spring actuated clamping force against and on either side of shaft 1 is sufficient to prevent coil 5 from unthreading itself out of the shaft during vigorous mixing action but allows coil 5 freedom to pivot angularly about center-line 3 of shaft 1 a total of about 40°, (+ or −20° from perpendicularity with center-line 3 of shaft 1). Pivotal freedom provides benefit in allowing coil 5 to remain squarely seated against the mixing container bottom, though shaft 1 is being held at angles as high as 20° out of perpendicularity with the container bottom. Additionally, coil to shaft pivotal freedom reduces wild and uncontrolled undulant shaft motion when the coil is pressed hard against the mixer container bottom when dislodging settled material.

No single mixer configuration can ideally be used for every mixing task encountered. Differences in the material to be mixed, with regard to viscosity, degree of settled solids, agglomeration of particulate matter, toleration of gas (air) entrapment, allowable mixing time, material quantity, and material depth must be considered when selecting an implement for the mixing task at hand. The present invention allows quick and easy configuration changes of mixer coil and shaft, without tools. By simply unthreading the existing coil 5 from shaft 1 and replacing it with another coil of more suitable length (but of like coil diameter, coil spacing and wire diameter), various combinations of coils and shaft lengths may be configured for tailoring the mixer to the mixing task.

Figure 2:
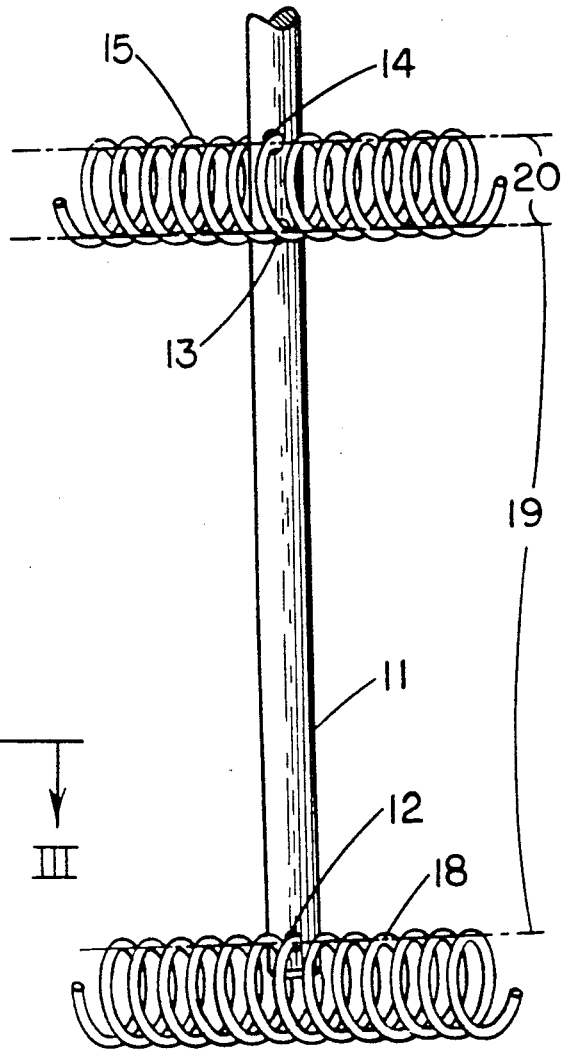
FIG. 2 is a perspective view according to the present invention mounted with a first coil through and near one end of the shaft and a second coil mounted through the shaft above and at some distance from the first coil.

FIG. 2 illustrates a mixing device according to the present invention. The shaft generally indicated by 11 has been provided with a first hole indicated by 12 near one end of shaft 11, substantially centered through the body of shaft 11 and perpendicular to the longitudinal axis of shaft 11. At some distance indicated by 19 from its end, shaft 11 has been provided with a second hole indicated by 13, and a third hole indicated by 14, also substantially centered through the body and perpendicular to the longitudinal axis of shaft 11, with a distance indicated by 20 between holes 13 and 14 to accommodate passage through shaft 11 of a coil indicated by 15. Let it be understood that the distance between first coil 15 and second coil 18 is fixed on any single shaft by design but may be varied in distance and number of individual coils mounted on a single shaft in designs for other applications.

Figure 3:
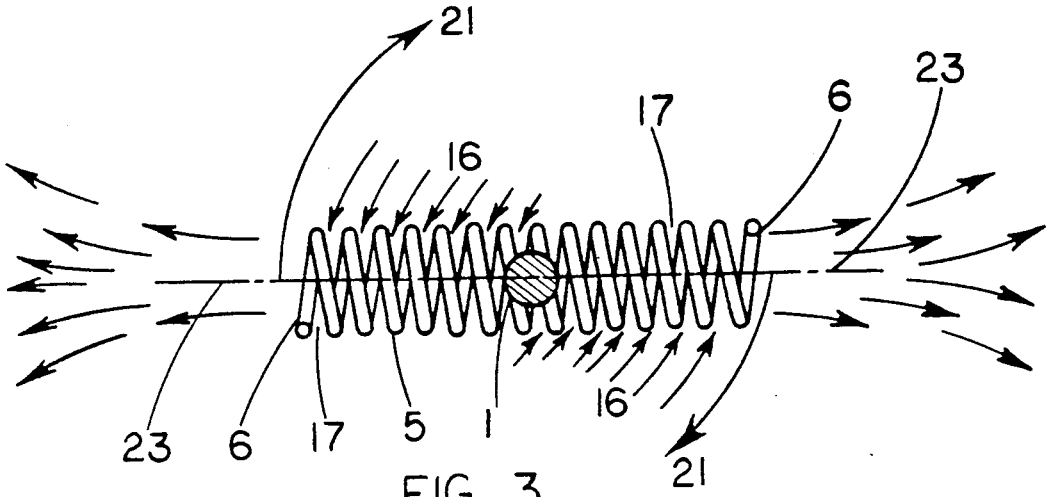
FIG. 3 is a cross section according to the present invention taken along line I—I in FIG. 1, showing a plan view of coil 5, together with anticipated material flow patterns through coil 5.

FIG. 3 shows a partial cross section along section I—I in FIG. 1, and shows a view of the present invention illustrating utilization of a unique fluid dynamics principle. A mixing implement, embodying coil 5 threaded substantially evenly through hole 2 in shaft 1, driven circularly generally indicated by arrows 21, allows material entry through frontal coil area generally indicated by 16, but prevents, to a certain extent, ready material exit through and past hind coil area generally indicated by 17. Hind coil area 17 substantially blocks the materials direct and unobstructed linear flow path out of the coil body. As coil 5 rotates, material within the confines of coil 5 is subjected to centrifugal forces, having the beneficial effect of pumping outwardly with substantial pressure material within the coil framework. Material exiting the confines of coil 5 creates a negative pressure area within the confines of coil 5 serving to draw replacement material from the area surrounding the exterior of coil 5.

Material in the path of coil 5 is first impinged upon frontal coil area 16, breaking up masses too large to fit between the individual loops of coil 5 in area 16. Upon entering the body of coil 5, material is struck again and deflected by hind coil loops 17, which partially blocks the material's linear exit through the rear area 17 of coil 5, trapping it within the tubular framework of coil 5. So trapped, both fluid and particulate matter are directed through the coil body parallel to its geometrical central axis indicated by 23. As coil rotational speed is increased, material is forced through the coil interior at accelerated rates, impinging upon coil loop surfaces at higher levels of impact velocity while being deflected at lessening values of particle to (coil) loop impingement angles. This processed flow pattern has the effect of causing rapid dissolution of solids into colloidal suspension.

The centrifugally induced circulation of material moving through the body of coil 5 is a continuous nonpulsating flow from both open coil ends 6. Flow pattern in the mixing container is observed in the form of material being drawn across the surface toward the rotating shaft 1, downward toward the submerged coil 5, thence outward from both coil ends 6, flowing up the container sides, across the surface to the shaft and once again into the coil. Flow is even, 360° about the container. All fluid material within the container is in motion within this flow pattern.

The naturally rounded and smooth coil shape has the added benefit of not scoring the mixing container bottom, even though the coil might be pressed hard against the bottom during attempts at remixing settled solids massed there.

Shafts 1 may be fitted with a collar indicated by 22 in FIG. 1, sized with a hole so that the collar, preferably, is snug on the shaft 1. Such a collar may also be present on the other embodiments of the present invention. The collar 22 is made of a material with resiliency and durability, such as Teflon, RTV rubber, or some other suitable material so that after mixing it may be slid down the shaft 1, pushing the mixed material clinging to the shaft toward the coil 5. This procedure reduces effort and cleaning time of the shaft. Mixing implements having only one coil located at the shaft end allow use of small amounts of cleaning fluid, solvent, water, or whatever is needed to remove residual material remaining on the end of shaft 1, coil 5, and cleaning disk 22. Typically, fluid for a single coil mixer need only be one inch deep to affect cleaning the mixer by immersion and rotation as in a normal method of a mixing motion. All mixer parts can be so cleaned and reused many times.

As with shaft 1 and coil 5, shaft cleaning collar 22 must be fabricated of material compatible with the material to be mixed, avoiding degradation of the disk and contamination of the mixed product.

Figure 4:
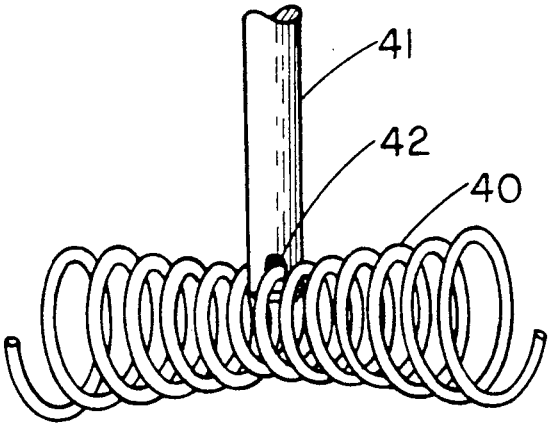
FIG. 4 is a perspective view of one embodiment of the present invention having a single coil with flared ends mounted through, and near one end of the shaft.

FIG. 4 illustrates a further embodiment of the mixing device according to the present invention. The coil 40 is mounted to the shaft 41 through hole 42 in the same manner as coil 5 to shaft 1 of FIG. 1. The coil diameter is smaller in the center than at either end, facilitating a modified material flow pattern through the coil. Materials of low viscosity present opportunity for using such shapes to increase coil surface area at points of greatest rotational radius of the coil 40, facilitating maximum fluid agitation at reduced rotational speeds of drive shaft 41.

Figure 5:
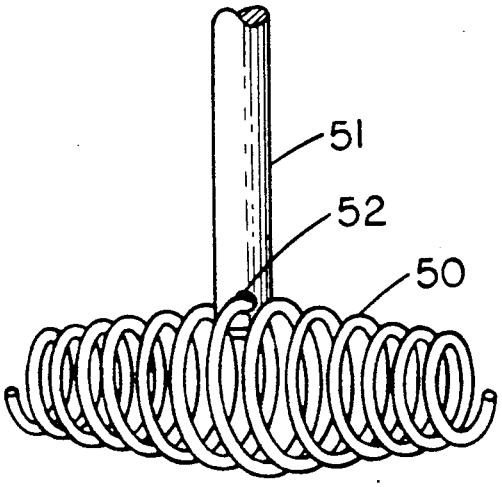
FIG. 5 is a perspective view of another embodiment according to the present invention having a single coil of oval design mounted through, and near one end of the shaft.

FIG. 5 illustrates another embodiment of a mixing device according to the present invention. The coil 50 is mounted to the shaft 51 through hole 52 in the same manner as coil 5 to shaft 1 of FIG. 1. The coil 50 diameter is larger in the center than at either end also to facilitate a modified material flow pattern through the coil 50. Materials of high viscosity present opportunity for use of such shapes due to reduced coil surface area at points of greatest coil rotational radius, facilitating motion of the coil through rheologically difficult masses with reduced levels of applied torque.

Let it be understood that coil configurations other than those described here in detail are possible. For instance, two coils, each on separate counter rotating shafts, set side by side, might be used to retro-fit existing household kitchen mixers and blenders or to construct new ones. Large devices employing the mixing principles set down here might be constructed by otherwise attaching coil to shaft, such as with clamps.

The scope of the present invention should not be limited by the specific embodiments herein taught, but should be interpreted solely on the basis of the following, appended claims.

What is claimed is:

1. A mixing implement comprising:

a substantially rigid shaft member having a first end, a second end, and a longitudinal axis; and a first coil element having a first end, a second end, a central longitudinal axis, and a longitudinal center; and means for coupling said first coil element to said second end of said substantially rigid shaft member essentially at the center of gravity along the longitudinal axis of said first coil element, said first coil element being coupled to said second and of said substantially rigid shaft member so that said central longitudinal axis of said first coil element is substantially perpendicular to said longitudinal axis of said substantially rigid shaft member; and said first coil element having a relatively stiff central longitudinal axis; and said means for coupling said first coil element to said second end of said substantially rigid shaft member comprising the attachment of a single coil loop of said first coil element to the second end of said substantially rigid shaft member.

2. A mixing implement as in claim 1, wherein said means for coupling comprises a first aperture defined through said rigid shaft member adjacent said second end, said first coil element being threaded through said first aperture.

3. A mixing implement as in claim 1, wherein the outer shape of said first coil element varies along said central longitudinal axis.

4. A mixing implement as in claim 3, wherein the radial distance from the longitudinal axis of said first coil element is greatest at said first and second ends and decreases toward said longitudinal center of said first coil element.

5. A mixing implement as in claim 3, wherein the radial distance from the longitudinal axis of said first coil element is greatest at said longitudinal center and decreases toward said first and second coil ends.

6. A mixing implement as in claim 1, wherein said substantially rigid shaft member is essentially a stiff drive shaft of fixed length and transmits torque to said first coil element essentially in a straight line.

7. A mixing implement as in claim 1, wherein said first coil element is essentially a stiff coil framework which withstands the applied torque in material to be mixed without substantially flexing along its longitudinal axis.

8. A mixing implement as in claim 1, wherein said substantially rigid shaft member may be rotationally driven by either hand held or permanently mounted power sources.

9. A mixing implement as in claim 1, wherein said first coil element is formed from an elongated material having a substantially circular cross-section.

10. A mixing implement as in claim 1, wherein said first coil element may be fabricated from elongated material having a cross-section other than circular.

11. A mixing implement as in claim 1, wherein said shaft member is formed from metal material of relatively low longitudinally flexibility.

12. A mixing implement as in claim 1, wherein said shaft member is formed from material of relatively low longitudinal flexibility other than metal.

13. A mixing implement as in claim 1, further comprising a second coil element having a first end, a second end, a central longitudinal axis, and a longitudinal center; and means for coupling said second coil element to said substantially rigid shaft member between said first end of said shaft member and said second end of said shaft member, said second coil element being coupled to said shaft member so that said central longitudinal axis of said second coil element is substantially perpendicular to said longitudinal axis of said shaft member.

14. A mixing implement as in claim 13, wherein said means for coupling said second coil element to said substantially rigid shaft member comprises second and third apertures defined through said shaft member between said first end and said second end thereof, said second coil member being threaded through said second and third apertures respectively.

15. A mixing implement as in claim 1, wherein said means for coupling allows movement of said first coil element relative to said substantially rigid shaft member so that said first coil element can be urged into a position other than perpendicular to the longitudinal axis of said substantially rigid shaft member.

16. A mixing implement according to claim 1, further comprising:

a collar member slidably mounted to said substantially rigid shaft, said collar member engaging said shaft member so that movement of said collar member relative to said shaft member wipes an outer surface of said shaft member.

17. A method for mixing comprising the steps of:

immersing a mixing implement comprising:

a substantially rigid shaft member having a first end, a second end, and a longitudinal axis; and a first coil element having a first end, a second end, a central longitudinal axis, and a longitudinal center; and said first coil element having a predetermined pitch between coil loops which is substantially the multiple of twice the width of the coil forming material; and said first coil element having a substantially rigid central longitudinal axis; and means for coupling said first coil element to said second end of said substantially rigid shaft member essentially at the center of gravity along the central longitudinal axis of said first coil element so that said first coil element is substantially perpendicular to said longitudinal axis of said substantially rigid shaft member; and attaching the first end of said substantially rigid shaft member to either a mobile or stationary power source of rotation; and immersing said first coil element in a material; and rotating said substantially rigid shaft member about said longitudinal axis thereof so as to rotate said first coil element about an axis of rotation substantially perpendicular to said central longitudinal axis of said first coil element at sufficient rotational velocity so as to cause said material residing within the interior framework defined by the coil element to be centrifugally ejected outward from within said interior framework of said coil element in a direction substantially parallel to the rotating central longitudinal axis of said rotating first coil element; and said ejected material causing a lower pressure area to be created within the body and adjacent to said first coil element; and said lower pressure area causing said material adjacent said first coil element to be drawn through the exterior of said first coil element with substantial force; and said first coil element sized proportionately to the mixing container so that said first coil element longitudinal axis value is less than said mixing container diametral value so as to preclude both ends of said first coil element from contacting said mixing container at two points diametrically opposed simultaneously.

* * * * *